US011008139B2

(12) United States Patent
Ziccardi et al.

(10) Patent No.: US 11,008,139 B2
(45) Date of Patent: May 18, 2021

(54) ERGONOMIC CAP REMOVER

(71) Applicants: Andrew Ziccardi, Barrington, IL (US); Eric Shannon, Eureka, MO (US)

(72) Inventors: Andrew Ziccardi, Barrington, IL (US); Eric Shannon, Eureka, MO (US)

(73) Assignee: ERGOCAP, Barrington, IL (US)

( * ) Notice: Subject to any disclaimer, the term of this patent is extended or adjusted under 35 U.S.C. 154(b) by 0 days.

(21) Appl. No.: 16/415,845

(22) Filed: May 17, 2019

(65) Prior Publication Data

US 2020/0231342 A1 Jul. 23, 2020

Related U.S. Application Data

(63) Continuation-in-part of application No. 15/674,394, filed on Aug. 10, 2017, now abandoned.

(51) Int. Cl.
*B65D 41/04* (2006.01)

(52) U.S. Cl.
CPC ..... *B65D 41/0485* (2013.01)

(58) Field of Classification Search
CPC .... B65D 17/44; B65D 41/0485; B65D 17/42; B65D 51/285; B65D 51/2835; B65D 2401/20; B65D 41/34; B67B 2007/0458; B67B 7/30; B67B 7/18; B67B 7/16
See application file for complete search history.

(56) References Cited

U.S. PATENT DOCUMENTS

| | | | | |
|---|---|---|---|---|
| 3,600,982 | A * | 8/1971 | Tholen | B67B 7/18 81/3.4 |
| 5,878,497 | A * | 3/1999 | Seemann, III | B67B 7/0441 30/1.5 |
| 2002/0030054 | A1* | 3/2002 | Boulange | B65D 39/08 220/265 |
| 2002/0092169 | A1* | 7/2002 | Kilduff | B67B 7/30 30/1.5 |
| 2017/0217651 | A2* | 8/2017 | Stirn | B67D 3/0061 |

* cited by examiner

*Primary Examiner* — Shawn M Braden
(74) *Attorney, Agent, or Firm* — James D Palmatier; Applied Patent Services, PC

(57) ABSTRACT

The invention is an ergonomic cap remover having an open end and an annular sidewall. The annular sidewall comprising a plurality of teeth extending inward and a. The open end opening to a closed cavity surrounded by the annular sidewall and a top. The closed cavity adapted to receive a cap on a bottle. The plurality of teeth adapted to engage the cap. The ergonomic cap remover comprising a means for providing purchase. The means for providing purchase may comprise knurling or tabs on the outside of the annular sidewall.

12 Claims, 2 Drawing Sheets

FIG. 1
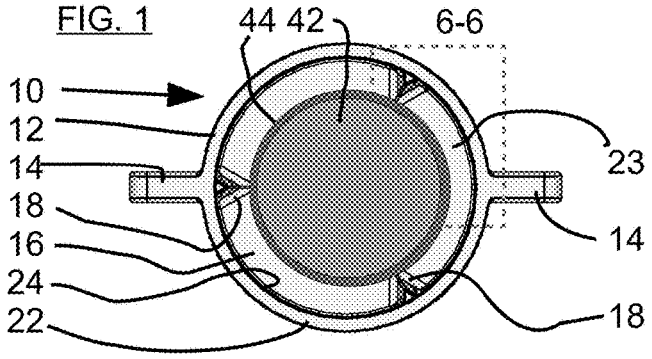
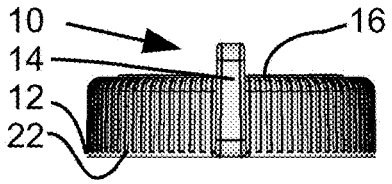
FIG. 2
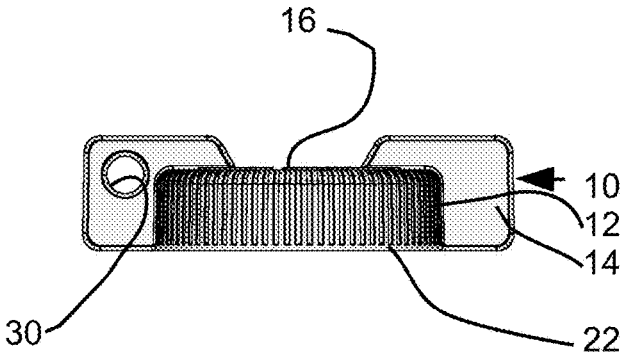
FIG. 4
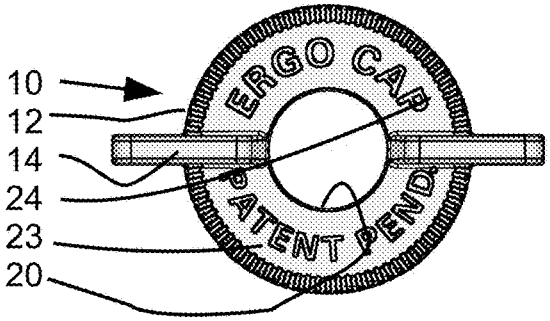
FIG. 3

ERGONOMIC CAP REMOVER

This application is a continuation-in-part of pending U.S. application Ser. No. 15/674,394 filed 10 Aug. 2017, the contents of which are hereby incorporated by reference.

FIELD OF THE INVENTION

The ergonomic cap remover relates generally to a device for the removal of caps from bottles namely water bottles and the like.

BACKGROUND OF THE INVENTION

Bottled water has become a part of everyday live all over the world. Bottled water is an answer to the need for safe potable water for people and animals. Bottled water production spans the market from basic bottled water for drinking to designer bottled water with flavors, vitamins and carbonation. A variety of other beverages are packaged in bottles having removable caps. The vast majority of these beverages are packaged in light weight clear plastic bottles with a screw on cap. To reduce the cost of producing, shipping and marketing bottled water, manufacturers have made the water bottles and caps thinner and lighter. The cap on a plastic water bottle is generally screw on the bottle.

As manufacturers develop bottles and caps with less plastic, and therefore less weight and less cost to make and ship, the cap has become smaller. As a result, the cap has become difficult for some people to open. People with hand problems or people that are young or old may have a hard time gripping the smaller cap to apply enough torque to break loose the tamper resistant ring and remove the cap. Further, the cap is to small to get purchase on the cap with a hand to overcome the sealing force holding the cap to the bottle.

Therefore, it is desirable to provide an ergonomic cap remover that can concentrically fit onto a cap to aid in the removal of the cap from the bottle. The ergonomic cap remover of the present invention is adapted to fit over a cap of a predetermined size to aid in the removal of the cap. The ergonomic cap remover may be reused. The ergonomic cap remover may be carried on the person for use when needed. The ergonomic cap remover may be hooked onto a key chain for storage. The ergonomic cap remover may offer a larger gripping surface than the cap to aid the user in getting purchase and applying torque to the cap for removal. The ergonomic cap remover may have appendages to increase the torque applied to the cap to help a person with soft or weak hands to open the bottle. The ergonomic cap remover may provide an appendage on the outside of the ergonomic cap remover to reinforce the structure of the ergonomic cap remover while providing a gripping surface adapted to help the user apply more torque with less effort in attempting to remove a cap. The structural rib supports the body of the ergonomic cap remover by being integrally molded on the outside. The structural rib may extend along the top and sides of the ergonomic cap remover. The structural rib may extend on the top of the cap where reinforcement of the thin material n the cap is subject to forces during manufacture and shipping.

The ergonomic cap remover may have an annular body with a hollow interior having an open end and a closed end, the open end adapted for accepting the cap therein. The ergonomic cap remover interior comprises a plurality of teeth or blades extending inwardly from the annular body. The teeth having a tapering shape to provide contact with a cap of varying size. The teeth are narrow defining a flush position on the inside of the annular body adjacent to the opening, the teeth have a tapered shape for holding an edge sloped from the inside of the annular opening toward the center. The teeth are spaced equidistant about the inside of the annular body interior along the inside surface. The teeth may be sloped for holding the edge closer to the center as the edge extends to the closed end of the annular body. The teeth slope may be continuous or stepped. The stepped slope adapted to having an edge supported at a first distance from the inside of the annular opening adjacent the open end and a second distance from the inside of the annular opening adjacent the closed end.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE SEVERAL VIEWS OF THE DRAWING

FIG. 1 is a bottom plan view of the ergonomic cap remover.

FIG. 2 is a side elevation view of the ergonomic cap remover.

FIG. 3 is a top plan view of the ergonomic cap remover.

FIG. 4 is a front elevation view of the ergonomic cap remover.

DETAILED DESCRIPTION OF THE INVENTION

Figure 5:
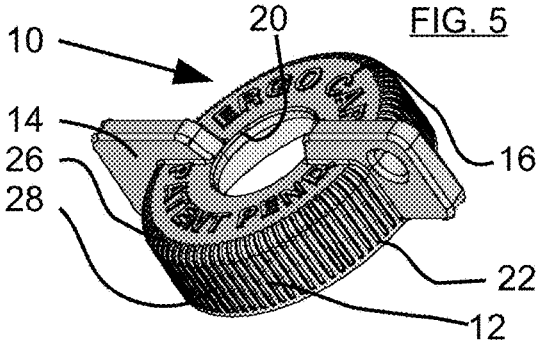
FIG. 5 is a perspective view of the ergonomic cap remover.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Referring to FIGS. 1-5, the invention comprises an ergonomic cap remover 10 comprising an annular sidewall 12, a plurality of tabs 14, a top 16 and a plurality of teeth 18. The ergonomic cap remover 10 further comprises an open bottom 22 surrounded by annular sidewall 12. The annular sidewall 12 may be integrally molded to the top 16 defining a hollow interior 23. Annular sidewall 12 may comprise an inner sidewall 22. Each one of the plurality of tabs 14 may be integrally molded to annular sidewall 12. Each one of the plurality of tabs 14 may project from annular side wall 12 and top 16. The top 16 may further comprise a cap removal hole 20 extending through cap top 16. Cap removal hole 20 adapted to help remove caps in open bottom 22.

Continuing to refer to FIGS. 1-5, each one of the plurality of tabs 14 may comprise a key chain hole 30 spaced from annular sidewall 12. Annular sidewall 12 may comprise ridges 28 and knurling 26 on an outer surface 39 to provide purchase by a user turning the ergonomic cap remover 10. Cap 42 may comprise outer surface 44. Teeth 18 may engage outer surface 44 to releasably attach ergonomic bottle cap remover 10 to cap 42.

Figure 6:
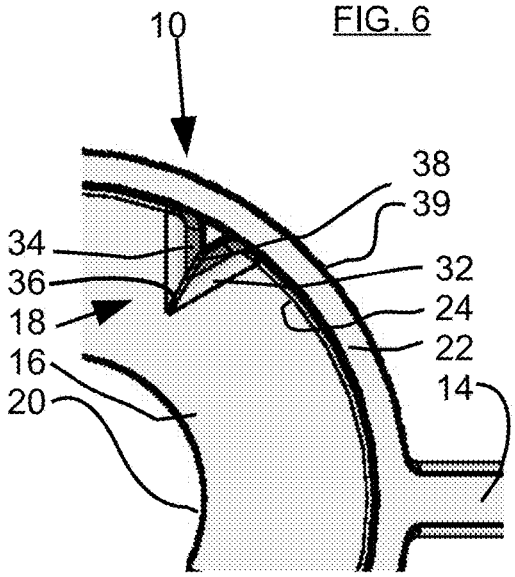
FIG. 6 is a section view taken at approximately 6-6 of FIG. 1.

Referring to FIG. 6, each of the plurality of teeth 18 may comprise a sloped edge 46 extending from top 16 to tooth end 48. Tooth end 48 may be disposed adjacent open end 22. Each of the plurality of teeth 18 may further comprise a plurality of engagement portions 32, 34. Each of the plurality of engagement portions 32, 34 may extend inward from inside surface 24. First engagement portion 32 may have a narrow knife edge first engagement surface 36, spaced from annular side wall 12. Second engagement portion 34 may have a similar narrow knife edge second engagement surface 38 spaced from annular side wall 12. Engagement surface 36 may not be parallel to engagement surface 38.

Figure 7:
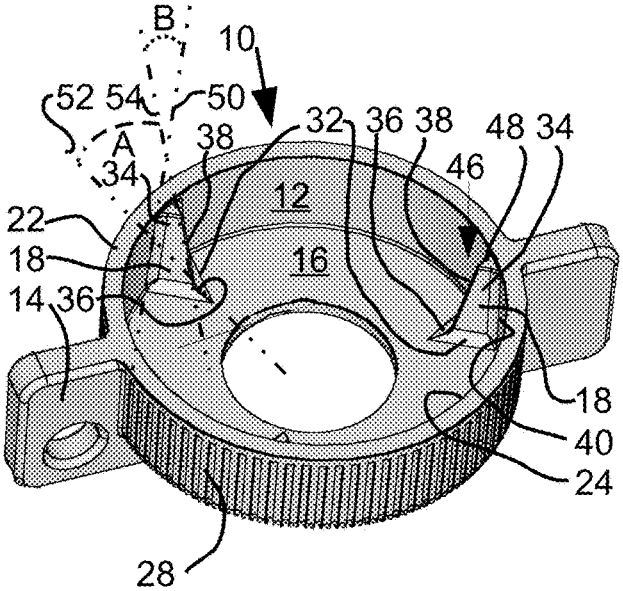
FIG. 7 is a bottom perspective of the ergonomic bottle cap remover of FIG. 1.

Referring to FIG. 7, the plurality of teeth 18 may have a plurality of cap engaging portions 32, 34. Each tooth 18 is disposed a generally equi-distance around inside perimeter of annular sidewall 12. Each tooth 18 may have an outside 40 on annular sidewall 12 and disposed generally perpendicular to top 16 represented by dimension line 50. First cap engaging surface 36 may be disposed at a first angle A to annular sidewall 12. Second cap engaging surface 38 may be disposed at a second angle B to annular side wall 12. Angle A may be larger than angle B.

Although the description above contains many specifications, these should not be construed as limiting the scope of the invention but as merely providing illustrations of some of the embodiments of this invention. Thus, the scope of the rather than by the examples given. Further, the present invention has been shown and described with reference to the foregoing exemplary embodiments. It is to be understood, however, that other forms, details, and embodiments may be made without departing from the spirit and scope of the invention which is defined in the following claims.

We claim:

1. An ergonomic cap remover, the ergonomic cap remover comprising:

a top;

an annular side wall comprising an outside, an inside and an open end, a plurality of teeth on the inside, the annular side wall on the top, each of the plurality of teeth on the annular side wall, each of the plurality of teeth comprising a back on the annular side wall, a first cap engagement surface and a second cap engagement surface, the first cap engagement surface disposed at a first angle to the annular side wall, the second cap engagement surface disposed at a second angle to the annular side wall, the first angle not equal to the second angle whereby the first cap engagement surface and second cap engagement surface form a sloped edge extending from annular side wall and into the inside wherein said first cap engagement surface is spaced a first distance from the inside, said second cap engagement surface is spaced a second distance from the inside, the first distance being smaller than the second distance.

2. The ergonomic cap remover of claim 1, further comprising a tab extending from the outside.

3. The ergonomic cap remover of claim 1, wherein each of the plurality of teeth further comprise a tooth end, each tooth end disposed adjacent the open end, each tooth end on the inside of the annular wall.

4. The ergonomic cap remover of claim 1, wherein each of the plurality of teeth are on the top and the annular side wall.

5. The ergonomic cap remover of claim 1, wherein the first cap engagement surface is on the top.

6. The ergonomic cap remover of claim 4, wherein the first cap engagement surface is on the top.

7. The ergonomic cap remover of claim 3, wherein the second cap engagement surface is on the tooth end.

8. The ergonomic cap remover of claim 7, wherein the open end is an open bottom, the tooth end on the first cap engagement surface, the tooth end on the open bottom.

9. The ergonomic cap remover of claim 1, further comprising a cap removal hole in the top, the cap removal hole extending into the inside.

10. An ergonomic cap remover comprising an annular sidewall, a plurality of tabs, a top, a plurality of teeth, and an open bottom surrounded by the annular sidewall, the annular sidewall comprising an inside surface, each of the plurality of teeth extending from the annular sidewall to the top, each of the plurality of teeth may further comprise a plurality of engagement portions each of the plurality of engagement portions extending inward from the inside surface, each of the plurality of engagement portions comprising a cap engagement surface, each cap engagement surface disposed at a different angle to the annular sidewall than each other of the cap engagement surfaces, the plurality of teeth disposed about the annular sidewall at an equidistance from each other of the plurality of teeth.

11. The ergonomic cap remover of claim 10, further comprising a cap removal hole in the top.

12. The ergonomic cap remover of claim 10, wherein each tooth further comprising an outside on the annular sidewall, each tooth outside disposed generally perpendicular to the top.

* * * * *